US007690209B2

(12) United States Patent
Matsuoka et al.

(10) Patent No.: US 7,690,209 B2
(45) Date of Patent: Apr. 6, 2010

(54) REFRIGERANT CHARGING METHOD IN REFRIGERATION SYSTEM USING CARBON DIOXIDE AS REFRIGERANT

(75) Inventors: Hiromune Matsuoka, Sakai (JP); Toshiyuki Kurihara, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 39 days.

(21) Appl. No.: 12/375,578

(22) PCT Filed: Aug. 8, 2007

(86) PCT No.: PCT/JP2007/065479

§ 371 (c)(1),
(2), (4) Date: Jan. 29, 2009

(87) PCT Pub. No.: WO2008/018480

PCT Pub. Date: Feb. 14, 2008

(65) Prior Publication Data

US 2009/0133413 A1 May 28, 2009

(30) Foreign Application Priority Data

Aug. 10, 2006 (JP) ..... 2006-218875

(51) Int. Cl.
*F25B 45/00* (2006.01)

(52) U.S. Cl. ..... 62/149; 62/292

(58) Field of Classification Search ..... 62/77, 62/149, 292

See application file for complete search history.

(56) References Cited

U.S. PATENT DOCUMENTS

| | | | | |
|---|---|---|---|---|
| 6,845,626 | B2 * | 1/2005 | Matsuoka et al. | 62/149 |
| 7,104,086 | B2 * | 9/2006 | Mizutani et al. | 62/474 |
| 7,210,300 | B2 * | 5/2007 | Suharno et al. | 62/77 |
| 7,310,956 | B2 * | 12/2007 | Meldahl et al. | 62/77 |

FOREIGN PATENT DOCUMENTS

| | | |
|---|---|---|
| JP | 52-55015 | 5/1977 |
| JP | 3012260 U | 4/1995 |
| JP | 2001-074342 A | 3/2001 |
| JP | 2003-120897 A | 4/2003 |

* cited by examiner

*Primary Examiner*—Melvin Jones
(74) *Attorney, Agent, or Firm*—Global IP Counselors

(57) ABSTRACT

A refrigerant charging method in an air conditioner using carbon dioxide as a refrigerant includes a first refrigerant charging step and a second refrigerant charging step. The first refrigerant charging step is a step of charging a refrigerant charging target portion including refrigerant communication pipes with refrigerant in a gas state until the pressure of the refrigerant charging target portion rises to a predetermined pressure after the start of charging. The second refrigerant charging step is a step of charging the refrigerant charging target portion with refrigerant in a liquid state until the amount of refrigerant charging the refrigerant charging target portion becomes a predetermined amount. The second refrigerant charging step occurring after the first refrigerant charging step.

20 Claims, 4 Drawing Sheets

REFRIGERANT CHARGING METHOD IN REFRIGERATION SYSTEM USING CARBON DIOXIDE AS REFRIGERANT

CROSS-REFERENCE TO RELATED APPLICATIONS

This U.S. National stage application claims priority under 35 U.S.C. §119(a) to Japanese Patent Application No. 2006-218875, filed in Japan on Aug. 10, 2006, the entire contents of which are hereby incorporated herein by reference.

TECHNICAL FIELD

The present invention relates to a refrigerant charging method in a refrigeration system that uses carbon dioxide as a refrigerant.

BACKGROUND ART

Conventionally, fluorocarbon (called "FC" below) has been mainly used as a refrigerant in refrigeration systems, and in recent years, the development of technology using carbon dioxide has progressed. In the field of in-vehicle air conditioners, air conditioners that use carbon dioxide as a refrigerant such as described in Japanese Patent Publication No. 2001-74342 have become publicly known, and in the field of hot water supplying devices, products that use carbon dioxide as a refrigerant are commercially available.

On the other hand, in the field of air conditioners for homes and air conditioners for commercial use, currently development is at the stage where it is progressing and has not reached the stage of commercialization.

SUMMARY OF THE INVENTION

In hot water supplying devices that have already been commercialized, the work of charging the refrigerant circuit with carbon dioxide as a refrigerant is performed in the manufacturing plant of the manufacturer. At present, it goes without saying that hot water supplying devices that use carbon dioxide as a refrigerant are spreading widely, and even in manufacturing plants, the demand to shorten the amount of time of the work of charging refrigerant circuits with refrigerant for mass production is small.

However, it is believed that if this spread continues to progress, then the problem of making more efficient the work of charging refrigerant circuits with carbon dioxide as a refrigerant will arise.

Further, with current commercial air conditioners and the like that use FC as a refrigerant, in buildings that are installation locations, oftentimes refrigerant communication pipes that interconnect the indoors and the outdoors is installed at that site and the work of charging the air conditioner with refrigerant is performed on site. Even when the outdoor unit of the air conditioner is charged with a predetermined amount of refrigerant beforehand, the work of charging the outdoor unit with additional refrigerant is performed on site in accordance with the length of the refrigerant communication pipes that have been installed on site. In the work of charging the refrigerant circuit with refrigerant on site, a technique is adopted where the spaces inside the pipes are placed in a vacuum state using a vacuum pump or the like, and then the refrigerant is fed to the inside of the refrigerant circuit from a canister.

However, in regard to the work of charging the air conditioner with refrigerant on site, even when carbon dioxide is used as the refrigerant, when a work procedure that is the same as in the case of conventional FC is used, drawbacks arise in that the amount of work time becomes longer and the air conditioner becomes unable to start air conditioning operation until a while after charging is completed.

It is an object of the present invention to provide a refrigerant charging method in a refrigeration system that uses carbon dioxide as a refrigerant, which refrigerant charging method can shorten the amount of time for charging the refrigeration system with the refrigerant and the amount of time until the refrigeration system becomes operable after being charged with the refrigerant.

A refrigerant charging method pertaining to a first aspect of the present invention is a refrigerant charging method when installing a refrigeration system that includes an utilization unit and a heat source unit and uses carbon dioxide as a refrigerant, interconnecting the utilization unit and the heat source unit via refrigerant communication pipes, and thereafter charging the refrigeration system with refrigerant, the method including a first refrigerant charging step and a second refrigerant charging step. The first refrigerant charging step is a step of charging a refrigerant charging target portion including the refrigerant communication pipes with refrigerant in a gas state until the pressure of the refrigerant charging target portion rises to a predetermined pressure after the start of charging. The second refrigerant charging step is a step of charging the refrigerant charging target portion with refrigerant in a liquid state until the amount of refrigerant charging the refrigerant charging target portion becomes a predetermined amount after the first refrigerant charging step.

At present, in manufacturing sites such as manufacturing plants of manufacturers, the work of charging, with refrigerant, a refrigeration system such as a hot water supplying device unit that includes a refrigeration cycle employing carbon dioxide as a refrigerant is performed, but charging, with carbon dioxide, a refrigeration system such as a commercial air conditioner at the installation site of the commercial air conditioner is not performed. In other words, currently carbon dioxide is often used as a refrigerant only in refrigeration systems where there is no work of charging the refrigeration systems at the installation site, and just refrigeration systems that have already been charged with refrigerant at the manufacturing site are commercially available.

However, considering that carbon dioxide will be used in refrigeration systems such as commercial air conditioners where refrigerant communication pipes that interconnect indoors and outdoors are often installed in buildings that are installation sites and where the work of charging the refrigeration systems with refrigerant is often performed thereafter, there will be a demand to make appropriate and efficient the work of charging the refrigeration systems with refrigerant.

Thus, the inventors of the present application variously considered the work of charging a refrigeration system with carbon dioxide as a refrigerant. First, in a refrigeration system that uses carbon dioxide as a refrigerant, when the temperature and pressure inside a refrigerant-charged container such as a canister that supplies refrigerant when charging a refrigerant charging target portion of the refrigeration system with refrigerant are in a state exceeding the critical temperature and the critical pressure, then the carbon dioxide inside the refrigerant-charged container becomes a critical state. Additionally, when the refrigerant begins to be supplied from the refrigerant-charged container to the refrigerant charging target portion that in a substantial vacuum state, sometimes the refrigerant changes phase to a dry ice state (solid state) as a result of the pressure suddenly dropping when the specific enthalpy of the refrigerant is relatively small. When the refrigerant changes phase to a solid state in the refrigerant charging target portion, the flow of the refrigerant inside the valves and pipes configuring the refrigerant charging target portion is hindered by the refrigerant that has become solid and the amount of time until charging of the refrigeration system with refrigerant is completed becomes longer, and the amount of time until the refrigeration system becomes operable after being charged with the refrigerant (the amount of time until the refrigerant in the solid state melts or sublimates) becomes longer.

In order to eliminate this problem, in the refrigerant charging method pertaining to the first aspect of the present invention, first, in the first refrigerant charging step, the refrigerant charging target portion including the refrigerant communication pipes is charged with refrigerant in a gas state whose specific enthalpy is relatively large until the pressure of the refrigerant charging target portion rises to a predetermined pressure after the start of charging, and thereafter, in the second refrigerant charging step, the refrigerant charging target portion is charged with refrigerant in a liquid state whose density is large in comparison to the refrigerant in the gas state until the amount of refrigerant charging the refrigerant charging target portion becomes a predetermined amount. According to this method, during the initial stage of charging, a phase change to a solid state of the refrigerant resulting from the pressure suddenly dropping can be avoided, and during the second refrigerant charging step thereafter, the speed with which the refrigerant charging target portion is charged with refrigerant can be raised by charging the refrigerant charging target portion with refrigerant in a liquid state while avoiding a phase change to a solid state of the refrigerant resulting from a drop in pressure when the refrigerant charging target portion is to be charged with refrigerant, so drawbacks where refrigerant in a solid state (dry ice) becomes a hindrance and the amount of time for charging becomes longer, or where the amount of time until the refrigeration system becomes operable after being charged with the refrigerant, can be controlled.

A refrigerant charging method pertaining to a second aspect of the present invention is a refrigerant charging method in a refrigeration system that uses carbon dioxide as a refrigerant, the method including first refrigerant charging step and a second refrigerant charging step. The first refrigerant charging step is a step of charging a refrigerant charging target portion of the refrigeration system with refrigerant in a gas state until the pressure of the refrigerant charging target portion reaches a predetermined pressure after the start of charging. The second refrigerant charging step is a step of charging the refrigerant charging target portion with refrigerant in a liquid state until the amount of refrigerant charging the refrigerant charging target portion becomes a predetermined amount after the first refrigerant charging step.

At present, in manufacturing sites such as manufacturing plants of manufacturers, the work of charging, with refrigerant, a refrigeration system such as a hot water supplying device unit that includes a refrigeration cycle employing carbon dioxide as a refrigerant is performed, but charging, with carbon dioxide, a refrigeration system such as a commercial air conditioner at the installation site of the commercial air conditioner is not performed. In other words, currently carbon dioxide is often used as a refrigerant only in refrigeration systems where there is no work of charging the a refrigeration systems at the installation site, and just refrigeration systems that have already been charged with refrigerant at the manufacturing site are commercially available. In addition, at present, refrigeration systems such as hot water supplying devices that use carbon dioxide as a refrigerant are not mass produced, the demand to shorten the amount of time of the work of charging refrigerant circuits with refrigerant for mass production is small.

However, considering that carbon dioxide will be used in refrigeration systems such as commercial air conditioners where refrigerant communication pipes that interconnect indoors and outdoors are often installed in buildings that are installation sites and where the work of charging the refrigeration systems with refrigerant is often performed thereafter, or considering that refrigeration systems are mass produced in manufacturing sites, there will be a demand to make appropriate and efficient the work of charging the refrigeration systems with refrigerant.

Thus, the inventors of the present application variously considered the work of charging a refrigeration system with carbon dioxide as a refrigerant. First, in a refrigeration system that uses carbon dioxide as a refrigerant, when the temperature and pressure inside a refrigerant-charged container such as a canister that supplies refrigerant when charging a refrigerant charging target portion of the refrigeration system with refrigerant are in a state exceeding the critical temperature and the critical pressure, then the carbon dioxide inside the refrigerant-charged container becomes a critical state. Additionally, when the refrigerant begins to be supplied from the refrigerant-charged container to the refrigerant charging target portion that in a substantial vacuum state, sometimes the refrigerant changes phase to a dry ice state (solid state) as a result of the pressure suddenly dropping when the specific enthalpy of the refrigerant is relatively small. When the refrigerant changes phase to a solid state in the refrigerant charging target portion, the flow of the refrigerant inside the valves and pipes configuring the refrigerant charging target portion is hindered by the refrigerant that has become solid and the amount of time until charging of the refrigeration system with refrigerant is completed becomes longer, and the amount of time until the refrigeration system becomes operable after being charged with the refrigerant (the amount of time until the refrigerant in the solid state melts or sublimates) becomes longer.

In order to eliminate this problem, in the refrigerant charging method pertaining to the second aspect of the present invention, first, in the first refrigerant charging step, the refrigerant charging target portion including the refrigerant communication pipes is charged with refrigerant in a gas state whose specific enthalpy is relatively large until the pressure of the refrigerant charging target portion rises to a predetermined pressure after the start of charging, and thereafter, in the second refrigerant charging step, the refrigerant charging target portion is charged with refrigerant in a liquid state whose density is large in comparison to the refrigerant in the gas state until the amount of refrigerant charging the refrigerant charging target portion becomes a predetermined amount. According to this method, during the initial stage of charging, a phase change to a solid state of the refrigerant resulting from the pressure suddenly dropping can be avoided, and during the second refrigerant charging step thereafter, the speed with which the refrigerant charging target portion is charged with refrigerant can be raised by charging the refrigerant charging target portion with refrigerant in a liquid state while avoiding a phase change to a solid state of the refrigerant resulting from a drop in pressure when the refrigerant charging target portion is to be charged with refrigerant, so drawbacks where refrigerant in a solid state (dry ice) becomes a hindrance and the amount of time for charging becomes longer, or where the amount of time until the refrigeration system becomes operable after being charged with the refrigerant, can be controlled.

A refrigerant charging method pertaining to a third aspect of the present invention comprises the refrigerant charging method pertaining to the first or second aspect of the present invention, wherein the predetermined pressure is 0.52 MPa.

In this refrigerant charging method, the method is configured to move from the first refrigerant charging step to the second refrigerant charging step after the pressure of the refrigerant charging target portion reaches 0.52 MPa which corresponds to the triple point temperature (−56.56° C.) of carbon dioxide, so during the second refrigerant charging step, a phase change to a solid state of the refrigerant resulting from a drop in pressure when the refrigerant charging target portion is to be charged with the refrigerant can be reliably avoided.

A refrigerant charging method pertaining to a fourth aspect of the present invention comprises the refrigerant charging method pertaining to the first or second aspect of the present invention, wherein the predetermined pressure is in the range of 1 MPa or higher and 1.4 MPa or lower.

In this refrigerant charging method, the method is configured to move from the first refrigerant charging step to the second refrigerant charging step after the pressure of the refrigerant charging target portion reaches the range of 1 MPa or higher and 1.4 MPa or lower which corresponds to the lowest use temperature (the range of −40° C. to −30° C.) of use parts valves and the like configuring the refrigerant charging target portion and portions in the vicinity thereof of the use parts configuring the refrigerant circuit of the refrigeration system, so during the second refrigerant charging step, the use parts of the refrigerant circuit can be protected in addition to reliably avoiding a phase change to a solid state of the refrigerant resulting from a drop in pressure when the refrigerant charging target portion is to be charged with the refrigerant.

A refrigerant charging method pertaining to a fifth aspect of the present invention comprises the refrigerant charging method pertaining to the first or second aspect of the present invention, wherein the predetermined pressure is 3.49 MPa.

In this refrigerant charging method, the method is configured to move from the first refrigerant charging step to the second refrigerant charging step after the pressure of the refrigerant charging target portion reaches 3.49 MPa which corresponds to the melting point (0° C.) of water, so during the second refrigerant charging step, the occurrence of icing and a large amount of condensation on the valves and the outer surfaces of the pipes can be controlled in addition to reliably avoiding a phase change to a solid state of the refrigerant resulting from a drop in pressure when the refrigerant charging target portion is to be charged with the refrigerant.

A refrigerant charging method pertaining to a sixth aspect of the present invention comprises the refrigerant charging method pertaining to the first to fifth aspects of the present invention, wherein the first refrigerant charging step is a step of sending refrigerant in a gas state from a refrigerant-charged container charged with refrigerant to the refrigerant charging target portion after heating the refrigerant in the gas state such that its specific enthalpy when entering the refrigerant charging target portion becomes equal to or greater than 430 kJ/kg.

In this refrigerant charging method, during the initial stage of charging, in order to ensure that a phase change to a solid state of the refrigerant resulting from the pressure suddenly dropping can be avoided, the refrigerant in the gas state is heated such that its specific enthalpy when entering the refrigerant charging target portion from the refrigerant-charged container charged with refrigerant becomes equal to or greater than 430 kJ/kg, so that even when the pressure of the refrigerant charging target portion is lower than the triple point pressure (0.52 MPa) of carbon dioxide, it is ensured that a phase change to a solid state of the refrigerant does not occur and the refrigerant is sent to the refrigerant charging target portion. Thus, during the initial stage of charging, a phase change to a solid state of the refrigerant resulting from the pressure suddenly dropping can be reliably avoided.

A refrigerant charging method pertaining to a seventh aspect of the present invention comprises the refrigerant charging method pertaining to the first to sixth aspects of the present invention, wherein the first refrigerant charging step is a step of sending refrigerant in a gas state from a refrigerant-charged container charged with refrigerant to the refrigerant charging target portion after cooling the refrigerant-charged container until it becomes 31° C. or lower.

In this refrigerant charging method, during the initial stage of charging, in order to ensure that a phase change to a solid state of the refrigerant resulting from the pressure suddenly dropping can be avoided, the refrigerant-charged container that feeds the refrigerant to the refrigerant charging target portion is cooled to 31° C. or lower, so it is ensured that the refrigerant inside the refrigerant-charged container is placed in a state that is not a critical state (i.e., a state where a liquid state and a gas state can exist) and that the refrigerant in the gas state is sent from the refrigerant-charged container to the refrigerant charging target portion. Thus, during the initial stage of charging, a phase change to a solid state of the refrigerant resulting from the pressure suddenly dropping can be reliably avoided.

DETAILED DESCRIPTION OF THE INVENTION

Embodiments of a refrigerant charging method in a refrigeration system that uses carbon dioxide as a refrigerant pertaining to the present invention will be described below on the basis of the drawings.

(1) Configuration of Air Conditioner

Figure 1:
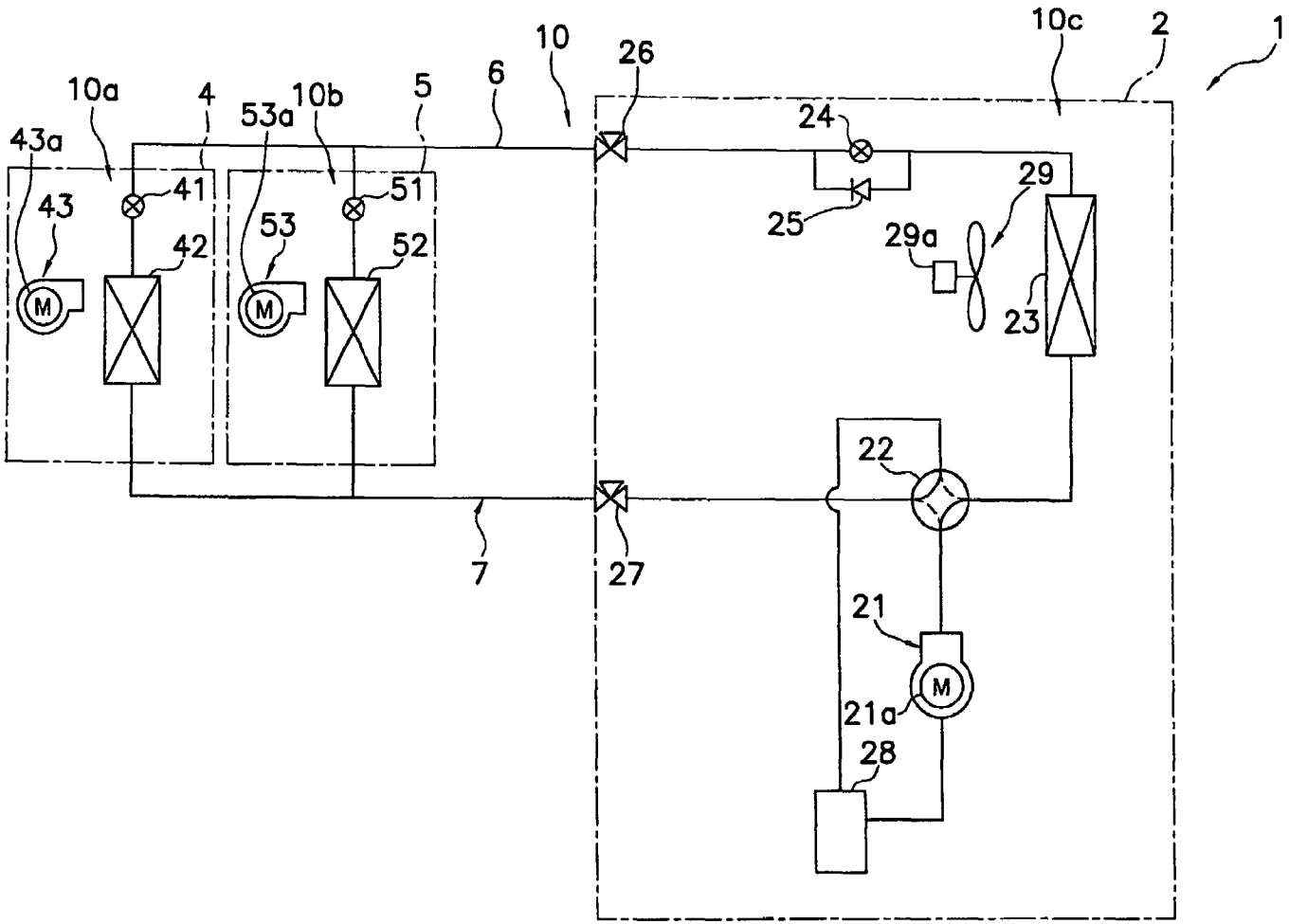
FIG. 1 is a general configural diagram of an air conditioner serving as an example of a refrigerant system that uses carbon dioxide as a refrigerant.

FIG. 1 is a general configural diagram of an air conditioner 1 serving as an example of a refrigeration system that uses carbon dioxide as a refrigerant. The air conditioner 1 is an apparatus used to cool and heat the inside of a room in a building or the like by performing vapor compression type refrigeration cycle operation. The air conditioner 1 is disposed with one heat source unit 2, plural (here, two) utilization units 4 and 5, and a first refrigerant communication pipe 6 and a second refrigerant communication pipe 7 serving as refrigerant communication pipes that interconnect the heat source unit 2 and the utilization units 4 and 5. That is, the air conditioner is a separate type air conditioner where a vapor compression type refrigerant circuit 10 of the air conditioner 1 is configured by the interconnection of the heat source unit 2, the utilization units 4 and 5, and the refrigerant communication pipes 6 and 7. Additionally, inside of the refrigerant circuit 10 is charged with carbon dioxide as a refrigerant, refrigeration cycle operation is performed where, as will be described later, the carbon dioxide is compressed, cooled, depressurized, evaporated, and thereafter again compressed.

<Utilization Units>

The utilization units 4 and 5 are installed by being embedded in or hung from a ceiling inside a room or by being mounted on a wall surface inside a room, or are installed in the space behind a ceiling or the space behind a wall and connected to the space inside the room via a duct or the like. The utilization units 4 and 5 are connected to the heat source unit 2 via the refrigerant communication pipes 6 and 7 to configure part of the refrigerant circuit 10.

Next, the configuration of the utilization units 4 and 5 will be described. It will be noted that because the utilization units 4 and 5 have the same configuration, just the configuration of the utilization unit 4 will be described here, and in regard to the configuration of the utilization unit 5, reference numerals in the 50s will be used instead of reference numerals in the 40s that represent respective portions of the utilization unit 4, and description of the respective portions will be omitted.

The utilization unit 4 mainly includes a utilization refrigerant circuit 10*a* (in the utilization unit 5, a utilization refrigerant circuit 10*b*) that configures part of the refrigerant circuit 10. The utilization refrigerant circuit 10*a* mainly includes a utilization expansion mechanism 41 and a utilization heat exchanger 42.

The utilization expansion mechanism 41 is a mechanism for depressurizing the refrigerant and, here, is an electrically powered expansion valve connected to one end of the utilization heat exchanger 42 in order to perform adjustment of the flow rate of the refrigerant flowing inside of the utilization refrigerant circuit 10*a*. One end of the utilization expansion mechanism 41 is connected to the utilization heat exchanger 42, and the other end is connected to the first refrigerant communication pipe 6.

The utilization heat exchanger 42 is a heat exchanger that functions as a heater or a cooler of the refrigerant. One end of the utilization heat exchanger 42 is connected to the utilization expansion mechanism 41, and the other end is connected to the second refrigerant communication pipe 7.

Here, the utilization unit 4 is disposed with a utilization fan 43 for sucking in room air into the unit and again supplying the room air to the inside of the room, so that the utilization unit 4 is capable of causing heat to be exchanged between the room air and the refrigerant flowing through the utilization heat exchanger 42. The utilization fan 43 is driven to rotate by a fan motor 43*a*.

<Heat Source Unit>

The heat source unit 2 is installed outdoors, is connected to the utilization units 4 and 5 via the refrigerant communication pipes 6 and 7, and configures the refrigerant circuit 10 between the utilization units 4 and 5.

Next, the configuration of the heat source unit 2 will be described. The heat source unit 2 mainly includes a heat source refrigerant circuit 10*c* that configures part of the refrigerant circuit 10. The heat source refrigerant circuit 10*c* mainly includes a compressor 21, a switch mechanism 22, a heat source heat exchanger 23, a heat source expansion mechanism 24, a first close valve 26, and a second close valve 27.

The compressor 21 here is sealed type compressor that is driven by a compressor drive motor 21*a*. It will be noted that although there is just one compressor 21 here, the compressor 21 is not limited to this and two or more compressors may also be connected in parallel in accordance with the connected number of utilization units. Further, in the heat source refrigerant circuit 10*c*, an accumulator 28 is disposed on a suction side of the compressor 21. The accumulator 28 is connected between the switch mechanism 22 and the compressor 21, and is a container capable of accumulating excess refrigerant occurring inside the refrigerant circuit 10 in accordance with the change in operational loads of the utilization units 4 and 5.

The switch mechanism 22 is a mechanism for switching the direction of the flow of the refrigerant inside the refrigerant circuit 10 such that, during cooling operation, the switch mechanism 22 is capable of interconnecting a discharge side of the compressor 21 and one end of the heat source heat exchanger 23 and interconnecting a suction side of the compressor 21 and the second close valve 27 in order to cause the heat source heat exchanger 23 to function as a cooler of refrigerant to be compressed by the compressor 21 and to cause the utilization heat exchangers 42 and 52 to function as heaters of refrigerant that has been cooled in the heat source heat exchanger 23 (refer to the solid line of the switch mechanism 22 in FIG. 1), and such that, during heating operation, the switch mechanism 22 is capable of interconnecting the discharge side of the compressor 21 and the second close valve 27 and interconnecting the suction side of the compressor 21 and one end of the heat source heat exchanger 23 in order to cause the utilization heat exchangers 42 and 52 to function as coolers of refrigerant to be compressed by the compressor 21 and to cause the heat source heat exchanger 23 to function as a heater of refrigerant that has been cooled in the utilization heat exchangers 42 and 52 (refer to the dotted line of the switch mechanism 22 in FIG. 1). The switch mechanism 22 is a four-way switch valve connected to the suction side of the compressor 21, the discharge side of the compressor 21, the heat source heat exchanger 23, and the second close valve 27. It will be noted that the switch mechanism 22 is not limited to a four-way switch valve and may also be one configured to include the same function as mentioned above of switching the direction of the flow of the refrigerant by combining plural electromagnetic valves, for example.

The heat source heat exchanger 23 is a heat exchanger that functions as a cooler or a heater of the refrigerant. One end of the heat source heat exchanger 23 is connected to the switch mechanism 22, and the other end is connected to the heat source expansion mechanism 24.

The heat source unit 2 includes a heat source fan 29 for sucking in outdoor air into the unit and discharging the outdoor air back to the outdoors. The heat source fan 29 is capable of causing heat to be exchanged between the outdoor air and the heat source heat exchanger 23. The heat source fan 29 is driven to rotate by a fan motor 29*a*. It will be noted that the heat source of the heat source heat exchanger 23 is not limited to outdoor air and may also be another heat medium such as water.

The heat source expansion mechanism 24 is a mechanism for depressurizing the refrigerant and, here, is an electrically powered expansion valve connected to the other end of the heat source heat exchanger 23 in order to perform adjustment of the flow rate of the refrigerant flowing inside of the heat source refrigerant circuit 10*c*. One end of the heat source expansion mechanism 24 is connected to the heat source heat exchanger 23, and the other end is connected to the first close valve 26. Further, in the heat source refrigerant circuit 10*c*, a check mechanism 25 is disposed so as to bypass the heat source expansion mechanism 24. The check mechanism 25 is a mechanism that allows flow of the refrigerant in one direction and cuts off flow of the refrigerant in the opposite direction. Here, the check mechanism 25 is a check valve that is disposed so as to allow flow of the refrigerant from the heat source heat exchanger 23 towards the first close valve 26 and to cut off flow of the refrigerant from the first close valve 26 towards the heat source heat exchanger 23.

The first close valve 26 is a valve to which is connected the first refrigerant communication pipe 6 for exchanging the refrigerant between the heat source unit 2 and the utilization units 4 and 5, and is connected to the heat source expansion mechanism 24. The second close valve 27 is a valve to which is connected the second refrigerant communication pipe 7 for exchanging the refrigerant between the heat source unit 2 and the utilization units 4 and 5, and is connected to the switch mechanism 22. Here, the first and second close valves 26 and 27 are three-way valves disposed with a service port capable of communication with the outside of the refrigerant circuit 10.

<Refrigerant Communication Pipes>

The refrigerant communication pipes 6 and 7 are refrigerant pipes that are installed on site when the air conditioner 1 is to be installed in an installation location. Pipes having various pipe diameters and lengths are used for the refrigerant communication pipes 6 and 7 in accordance with the conditions of the capacity of the apparatus determined by the combination of the utilization units and the heat source unit and the conditions of the installation location.

As described above, the refrigerant circuit 10 is configured by the interconnection of the utilization refrigerant circuits 10*a* and 10*b*, the heat source refrigerant circuit 10*c*, and the refrigerant communication pipes 6 and 7.

(2) Operation of Air Conditioner

Next, operation of the air conditioner 1 will be described.

<Cooling Operation>

During cooling operation, the switch mechanism 22 is in the state indicated by the solid lines in FIG. 1, that is, a state where the discharge side of the compressor 21 is connected to the heat source heat exchanger 23 and where the suction side of the compressor 21 is connected to the second close valve 27. The heat source expansion mechanism 24 is completely closed. The close valves 26 and 27 are opened. The openings of the utilization expansion mechanisms 41 and 51 are adjusted in accordance with the loads of the utilization heat exchangers 42 and 52.

In this state of the refrigerant circuit 10, when the compressor 21, the heat source fan 29 and the utilization fans 43 and 53 are started, low-pressure refrigerant is sucked into the compressor 21, compressed, and becomes high-pressure refrigerant. Thereafter, the high-pressure refrigerant is sent to the heat source heat exchanger 23 via the switch mechanism 22, heat exchange is performed with the outdoor air supplied by the heat source fan 29, and the high-pressure refrigerant is cooled. Then, the high-pressure refrigerant that has been cooled in the heat source heat exchanger 23 is sent to the utilization units 4 and 5 via the check mechanism 30, the first close valve 26 and the first refrigerant communication pipe 6. The high-pressure refrigerant that has been sent to the utilization units 4 and 5 is depressurized by the utilization expansion mechanisms 41 and 51, becomes low-pressure refrigerant in a gas-liquid two-phase state, is sent to the utilization heat exchangers 42 and 52, is evaporated as a result of being heated when heat exchange is performed in the utilization heat exchangers 42 and 52, and becomes low-pressure refrigerant.

The low-pressure refrigerant that has been heated in the utilization heat exchangers 42 and 52 is sent to the heat source unit 2 via the second refrigerant communication pipe 7 and flows into the accumulator 28 via the second close valve 27 and the switch mechanism 22. Then, the low-pressure refrigerant flowing into the accumulator 28 is again sucked into the compressor 21.

<Heating Operation>

During heating operation, the switch mechanism 22 is in the state indicated by the dotted lines in FIG. 1, that is, a state where the discharge side of the compressor 21 is connected to the second close valve 27 and where the suction side of the compressor is connected to the heat source heat exchanger 23. The opening of the heat source expansion mechanism 24 is adjusted in order to depressurize the refrigerant until the refrigerant is capable of being evaporated in the heat source heat exchanger 23. Further, the first close valve 26 and the second close valve 27 are opened. The openings of the utilization expansion mechanisms 41 and 51 are adjusted in accordance with the loads of the utilization heat exchangers 42 and 52.

In this state of the refrigerant circuit 10, when the compressor 21, the heat source fan 29 and the utilization fans 43 and 53 are started, low-pressure refrigerant is sucked into the compressor 21, compressed to a pressure that exceeds the critical pressure, and becomes high-pressure refrigerant. The high-pressure refrigerant is sent to the utilization units 4 and 5 via the switch mechanism 22, the second close valve 27 and the second refrigerant communication pipe 7.

Then, the high-pressure refrigerant that has been sent to the utilization units 4 and 5 is cooled as a result of heat exchange being performed with the room air in the utilization heat exchangers 41 and 51, and is thereafter depressurized in accordance with the openings of the utilization expansion mechanisms 41 and 51 when the high-pressure refrigerant passes through the utilization expansion mechanisms 41 and 51.

The refrigerant passing through the utilization expansion mechanisms 41 and 51 is sent to the heat source unit 2 via the first refrigerant communication pipe 6, is further depressurized via the first close valve 26 and the heat source expansion mechanism 24, and thereafter flows into the heat source heat exchanger 23. Then, the low-pressure refrigerant in the gas-liquid two-phase state flowing into the heat source heat exchanger 23 is evaporated as a result of being heated when heat exchange is performed with the outdoor air supplied by the heat source fan 29, becomes low-pressure refrigerant, and flows into the accumulator 24 via the switch mechanism 22. Then, the low-pressure refrigerant flowing into the accumulator 24 is again sucked into the compressor 21.

(3) Refrigerant Charging Method Pertaining to First Embodiment

With respect to on-site installation of the air conditioner 1, the following refrigerant charging work is performed after the refrigerant circuit 10 has been formed (here, the close valves 26 and 27 are closed) as a result of the heat source unit 2 and the utilization units 4 and 5 being installed on site and the heat source unit 2 and the utilization units 4 and 5 being interconnected via the refrigerant communication pipes 6 and 7 by pipe installation.

Figure 2:
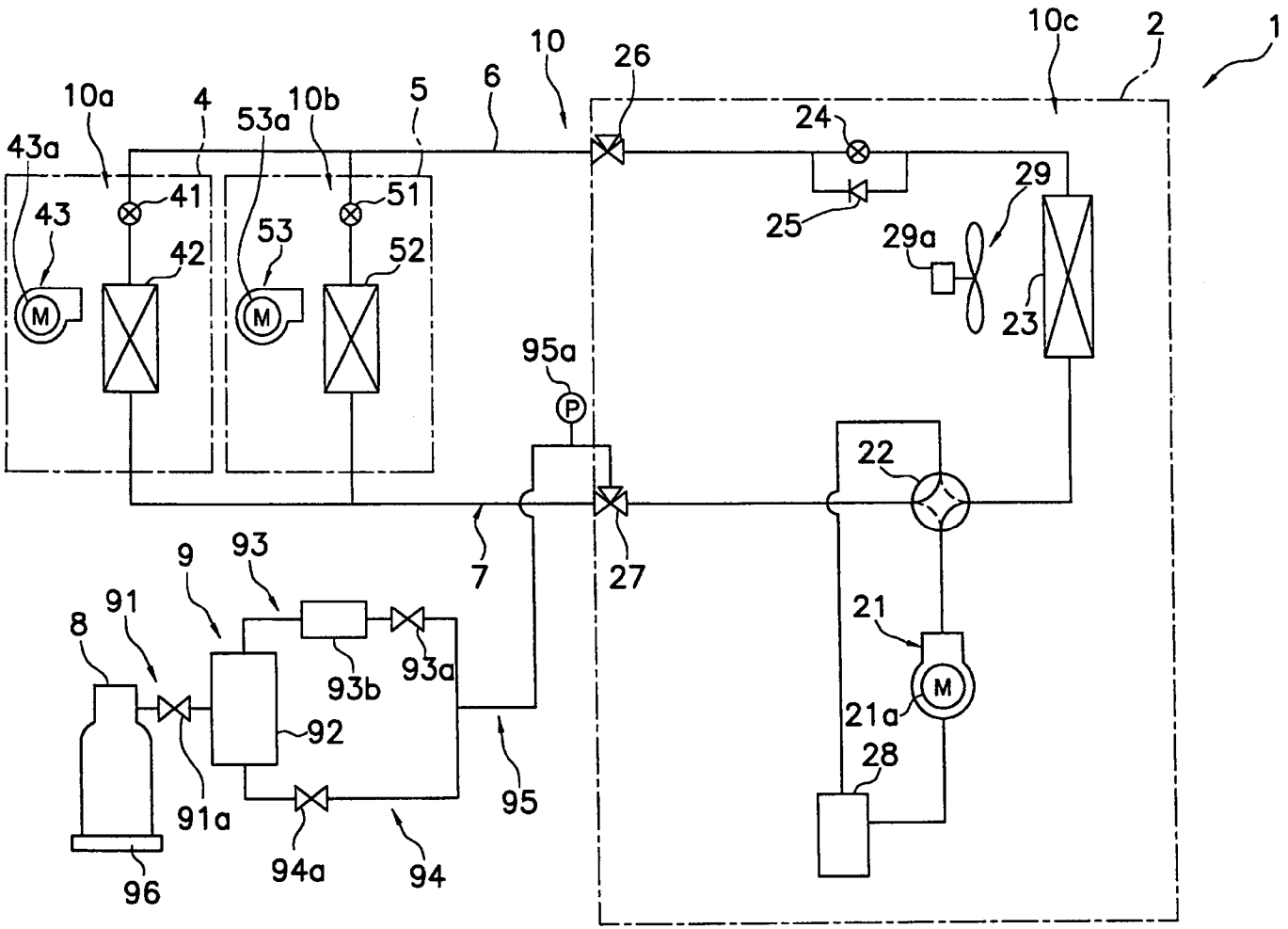
FIG. 2 is a general configural diagram of the air conditioner in a state where a canister and a refrigerant charging unit used in a refrigerant charging method pertaining to a first embodiment of the present invention are connected thereto.

In the refrigerant charging method pertaining to the present embodiment, first, the insides of the utilization refrigerant circuits 10*a* and 10*b* of the utilization units 4 and 5 and the refrigerant communication pipes 6 and 7 (called "refrigerant charging target portion" below) are made into vacuums (an extremely low pressure) by an unillustrated vacuum pump or the like. Next, as shown in FIG. 2, a canister 8 serving as a refrigerant-charged container charged with refrigerant (carbon dioxide) is connected to a service port of the second close valve 27 of the heat source unit 2 via a refrigerant charging unit 9. Here, FIG. 2 is a general configural diagram of the air conditioner 1 in a state where the canister 8 and the refrigerant charging unit 9 used in the refrigerant charging method pertaining to a first embodiment of the present invention are connected thereto. It will be noted that the position where the canister 8 is connected to the refrigerant charging target portion is not limited to the service port of the second close valve 27 and may also be a service port of the first close valve 26, or when a separate charge port is disposed in the vicinities of the close valves 26 and 27, then the canister 8 may also be connected to such a charge port.

Here, the refrigerant charging unit 9 is a unit for enabling the refrigerant to be separated in a gas and a liquid when the refrigerant charging target portion is to be charged with refrigerant from the canister 8 and to charge the refrigerant charging target portion with the gas refrigerant that has been gas-liquid separated and charge the refrigerant target portion with the liquid refrigerant that has been gas-liquid separated. The refrigerant charging unit 9 mainly includes an inlet pipe 91, a gas-liquid separator 92, a gas outlet pipe 93, a liquid outlet pipe 94, and a junction pipe 95.

The inlet pipe 91 configures a flow path that sends the refrigerant inside the canister 8 to the gas-liquid separator 92. One end of the inlet pipe 91 is connected to the canister 8, and the other end is connected to the gas-liquid separator 92. Additionally, an inlet valve 91*a* that opens and closes the flow of the refrigerant from the canister 8 to the gas-liquid separator 92 is disposed in the inlet pipe 91.

The gas-liquid separator 92 is a device for separating, into a gas and a liquid, the refrigerant flowing in through the inlet pipe 91, and here has a structure where the gas refrigerant that has been gas-liquid separated accumulates in the upper portion and the liquid refrigerant that has been gas-liquid separated accumulates in the lower portion.

The gas outlet pipe 93 configures a flow path that allows the gas refrigerant that has been separated in the gas-liquid separator 92 to flow out. One end of the gas outlet pipe 93 is connected to the portion of the gas-liquid separator 92 where the gas refrigerant that has been gas-liquid separated accumulates, and the other end is connected to the junction pipe 95. Additionally, a gas outlet valve 93*a* that opens and closes the flow of the gas refrigerant from the gas-liquid separator 92 to the junction pipe 95 and a heater 93*b* that heats the gas refrigerant flowing inside the gas outlet pipe 93 are disposed in the gas outlet pipe 93.

The liquid outlet pipe 94 configures a flow path that allows the liquid refrigerant that has been separated in the gas-liquid separator 92 to flow out. One end of the liquid outlet pipe 94 is connected to the portion of the gas-liquid separator 92 where the liquid refrigerant that has been gas-liquid separated accumulates, and the other end is connected to the junction pipe 95. Additionally, a liquid outlet valve 94*a* that opens and closes the flow of the liquid refrigerant from the gas-liquid separator 92 to the junction pipe 95 is disposed in the liquid outlet pipe 94.

One end of the junction pipe 95 is connected to the other end of the gas outlet pipe 93 and to the other end of the liquid outlet pipe 94, and the other end is connected to the service port of the second close valve 27, that is, the refrigerant charging target portion of the air conditioner 1. Additionally, a pressure gauge 95*a* is disposed in the junction pipe 95 and is configured to be able to measure the pressure of the refrigerant corresponding to the pressure of the refrigerant charging target portion.

Further, the canister 8 is placed on a scale 96 so that the amount of refrigerant with which the refrigerant charging target portion is to be charged can be measured.

Figure 3:
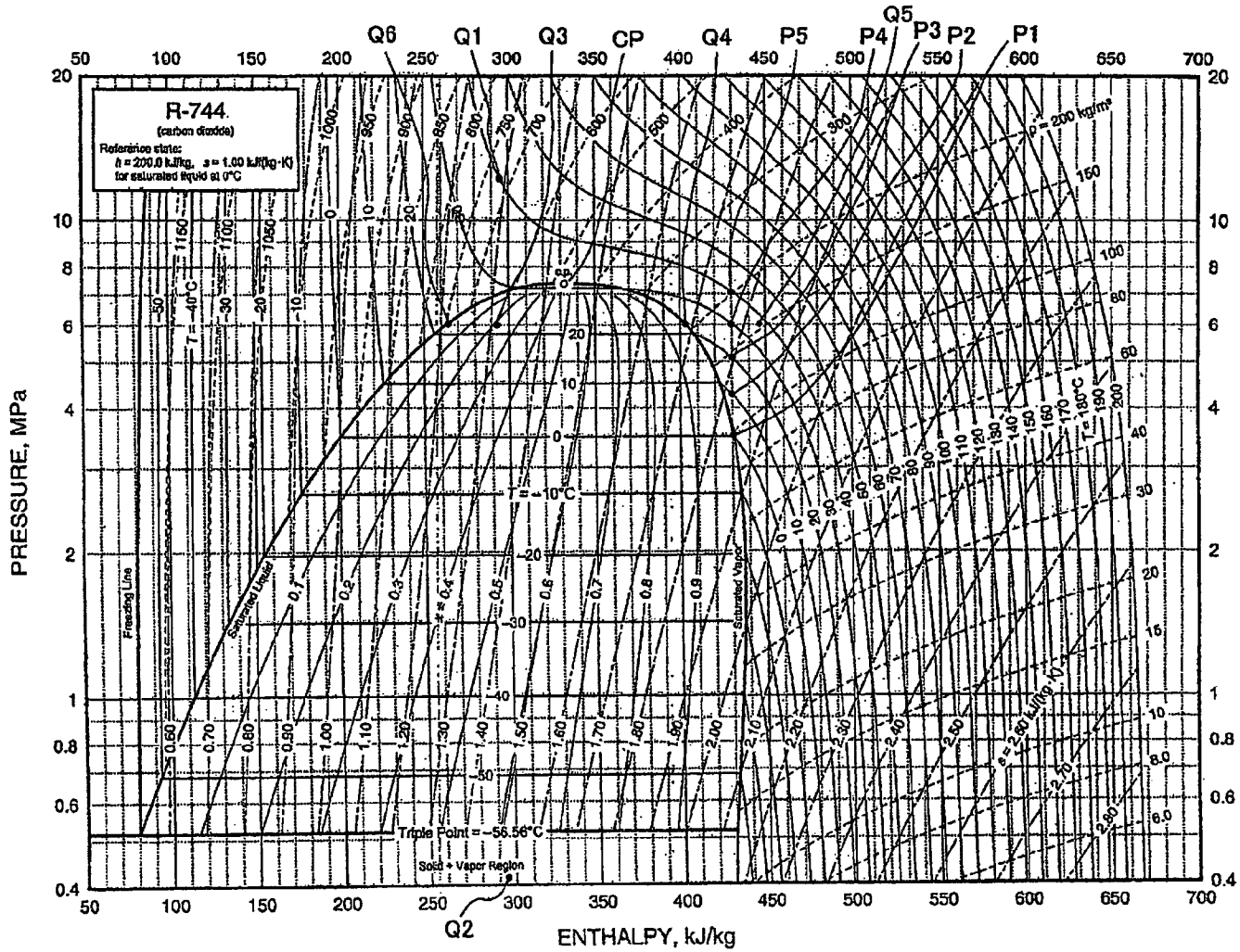
FIG. 3 is a Mollier diagram of carbon dioxide (source: Fundamentals: 2005 Ashrae Handbook: Si Edition).

In this refrigerant charging configuration, first, as a first refrigerant charging step, the inlet valve 91*a* and the gas outlet valve 93*a* are placed in an open state and the liquid outlet valve 94*a* is placed in a closed state to place the heater 93*b* in an activated state. Then, the refrigerant emerging from the canister 8 flows into the gas-liquid separator 92 while being depressurized through the inlet pipe 91 and is gas-liquid separated into gas refrigerant and liquid refrigerant, thereafter the liquid refrigerant accumulates inside the gas-liquid separator 92, the gas refrigerant is heated by the heater 93*b* such that its specific enthalpy when entering the refrigerant charging target portion becomes equal to or greater than 430 kJ/kg, and thereafter the gas refrigerant flows into the refrigerant charging target portion while being depressurized to the pressure of the refrigerant charging target portion through the gas outlet valve 93 and the junction pipe 95. Specifically, the heater 93*b* is activated such that the temperature and pressure of the refrigerant when entering the refrigerant charging target portion is present in region higher than the line joining points P1 to P5 shown in FIG. 3. Here, point P1 is a point where the temperature is 0° C. and the pressure is 3.49 MPa, point P2 is a point where the temperature is 10° C. and the pressure is 4.24 MPa, point P3 is a point where the temperature is 20° C. and the pressure is 5.07 MPa, point P4 is a point where the temperature is 30° C. and the pressure is 6.00 MPa, and point P5 is a point where the temperature is 40° C. and the pressure is 7.06 MPa. Here, FIG. 3 is a Mollier diagram of carbon dioxide (source: Fundamentals: 2005 Ashrae Handbook Si Edition).

According to the first refrigerant charging step, during the initial stage of charging, a phase change to a solid state of the refrigerant resulting from the pressure suddenly dropping can be avoided.

Figure 4:
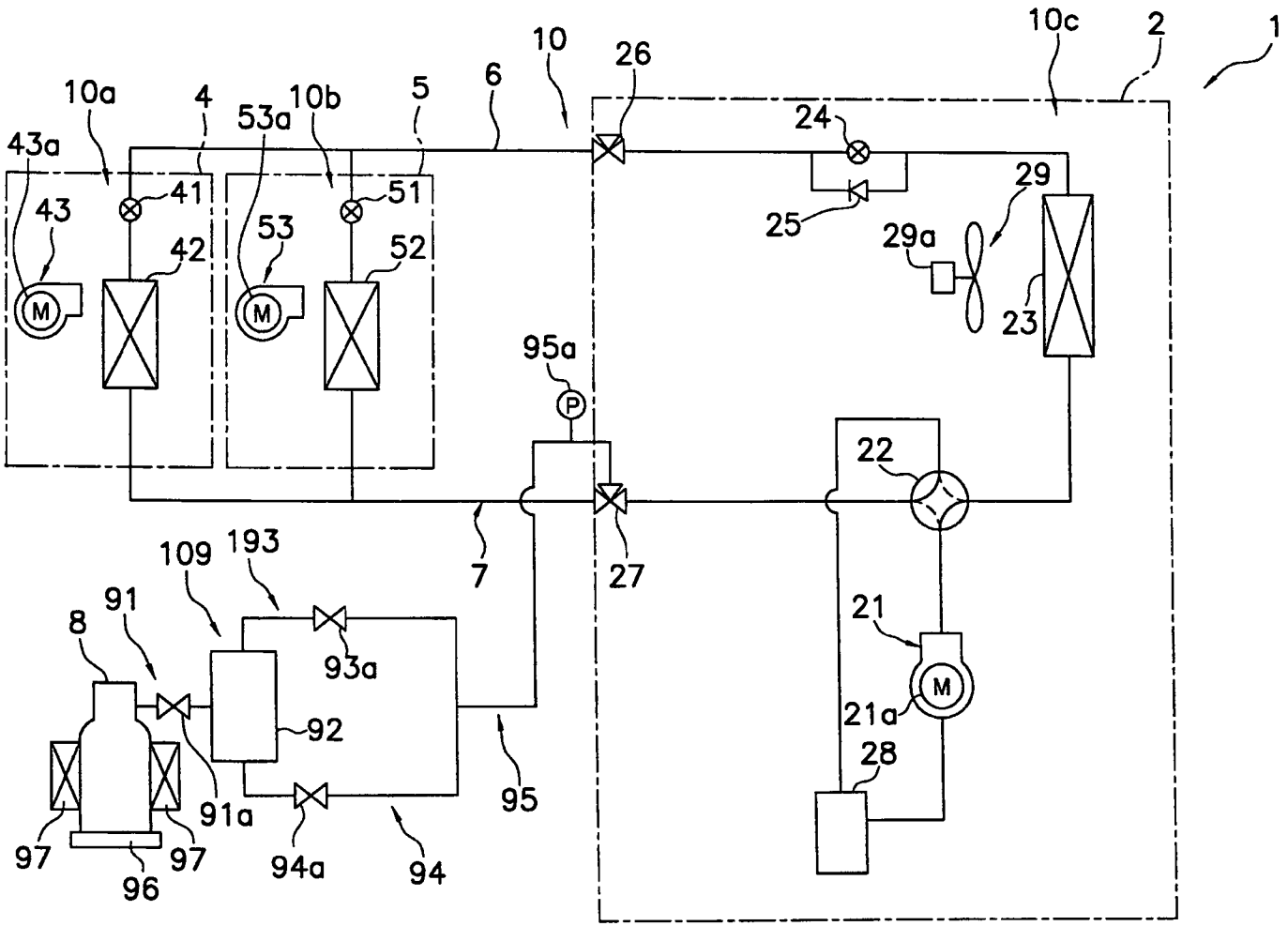
FIG. 4 is a general configural diagram of the air conditioner in a state where a canister and a refrigerant charging unit used in a refrigerant charging method pertaining to a second embodiment of the present invention are connected thereto.

That is, as shown in FIG. 3, when the specific enthalpy of carbon dioxide serving as a refrigerant whose temperature and pressure are higher than the temperature and pressure at a critical point CP (critical temperature of about 31° C., critical pressure of about 7.3 MPa) of carbon dioxide is less than 430 kJ/kg, then the carbon dioxide changes phases in the region of FIG. 4 where the pressure is equal to or lower than 0.52 MPa and the specific enthalpy is less than 430 kJ/kg and changes to a solid state when a sudden pressure drop occurs. For example, when, in a supercritical state (refer to point Q1 in FIG. 3) where the temperature of the refrigerant inside the canister 8 is 40° C. and the pressure is 12 MPa, the refrigerant charging target portion is charged with refrigerant directly without the intervention of the refrigerant charging unit 9, then the carbon dioxide changes phases from the state of point Q1 to the state of point Q2 where the temperature and pressure are lower than the triple point (triple point temperature of −56.56° C., triple point pressure of 0.52 MPa) and changes to a solid state during the initial stage of charging because the pressure of the refrigerant charging target portion is lower than 0.52 MPa which is the triple point pressure of carbon dioxide. In order to prevent this, here, the gas refrigerant (refer to point Q4 in FIG. 3) that has been gas-liquid separated in the gas-liquid separator 92 after leaving the canister 8 and being depressurized (e.g., assuming a case where the refrigerant is depressurized to about 6 MPa; refer to point Q3 in FIG. 3) is heated by the heater 93*b* to ensure that the specific enthalpy of the gas refrigerant when entering the refrigerant charging target portion becomes equal to or greater than 430 kJ/kg (refer to point Q5 in FIG. 3). Thus, no matter how much the pressure suddenly drops when the refrigerant enters the refrigerant charging target portion during the initial stage of charging, the refrigerant does not change into a solid state. This is because, as shown in FIG. 3, carbon dioxide does not change into a solid as long as its specific enthalpy is 430 kJ/kg or greater.

Additionally, when the first refrigerant charging step is continued, the pressure of the refrigerant charging target portion is boosted, and the pressure measured by the pressure gauge 95*a* reaches 0.52 MPa as a predetermined pressure. Here, "0.52 MPa as a predetermined pressure" is the triple point pressure which corresponds to the triple point temperature (−56.56° C.) of carbon dioxide, and this is so that, a phase change to a solid state of the refrigerant resulting from a drop in pressure when the refrigerant target charging portion is to be charged with the refrigerant can be prevented after the refrigerant charging target portion is charged with refrigerant until the pressure of the refrigerant charging target portion becomes equal to or higher than this pressure, as shown in FIG. 3.

Then, when the pressure measured by the pressure gauge 95*a* reaches 0.52 MPa as mentioned above, the first refrigerant charging step ends and the method moves to a second refrigerant charging step. In the second refrigerant charging step, the liquid outlet valve 94*a* is placed in an open state and the gas outlet valve 93*a* is placed in a closed state. Then, the refrigerant emerging from the canister 8 flows into the gas-liquid separator 92 while being depressurized through the inlet pipe 91 and is gas-liquid separated into gas refrigerant and liquid refrigerant, the gas refrigerant accumulates inside the gas-liquid separator 92, and the liquid refrigerant flows into the refrigerant charging target portion while being depressurized to the pressure of the refrigerant charging target portion through the liquid outlet pipe 94 and the junction pipe 95.

According to the second refrigerant charging step, the speed with which the refrigerant charging target portion is charged with refrigerant can be raised by charging the refrigerant charging target portion with refrigerant in a liquid state (refer to point Q6 in FIG. 3).

Additionally, when the second refrigerant charging step is continued, the amount of refrigerant with which the refrigerant charging target portion has been charged through the first and second refrigerant charging steps reaches a predetermined amount. Here, the amount of refrigerant with which the refrigerant charging target portion has been charged is obtained from the value of the change in the weight of the canister 8 measured by the scale 96.

As mentioned above, in the refrigerant charging method pertaining to the first embodiment, first, in the first refrigerant charging step, the refrigerant charging target portion including the refrigerant communication pipes 6 and 7 (here, the utilization refrigerant circuits 10*a* and 10*b* of the utilization units 4 and 5 and the refrigerant communication pipes 6 and 7 that have been vacuumed) is charged with refrigerant in a gas state whose specific enthalpy is relatively large until the pressure of the refrigerant charging target portion rises to a predetermined pressure from the start of charging, and thereafter, in the second refrigerant charging step, the refrigerant charging target portion is charged with refrigerant in a liquid state whose density is large in comparison to the refrigerant in the gas state until the amount of refrigerant with which the refrigerant charging target portion has been charged becomes a predetermined amount. According to this method, during the initial stage of charging, a phase change to a solid state of the refrigerant resulting from the pressure suddenly dropping can be avoided, and thereafter, during the second refrigerant charging step, the speed with which the refrigerant target charging portion is charged with the refrigerant can be raised by charging the refrigerant charging target portion with refrigerant in a liquid state while avoiding a phase change to a solid state of the refrigerant resulting from a drop in pressure when the refrigerant charging target portion is to be charged with the refrigerant, so drawbacks where refrigerant in a solid state (dry ice) becomes a hindrance and the amount of time for charging becomes longer, shortening of the amount of time for charging the refrigeration system with refrigerant, or where the amount of time until the refrigeration system becomes operable after being charged with the refrigerant, can be controlled.

Additionally, in this refrigerant charging method, the method moves from the first refrigerant charging step to the second refrigerant charging step after the pressure of the refrigerant charging target portion reaches 0.52 MPa which corresponds to the triple point temperature (−56.56° C.) of carbon dioxide, so during the second refrigerant charging step, a phase change to a solid state of the refrigerant resulting from a drop in pressure when the refrigerant charging target portion is to be charged with the refrigerant can be reliably avoided.

Moreover, in this refrigerant charging method, during the first refrigerant charging step of the initial stage of charging, refrigerant in a gas state is heated such that its specific enthalpy when entering the refrigerant charging target portion from the canister 8 serving as a refrigerant-charged container charged with refrigerant becomes equal to or greater than 430 kJ/kg in order to ensure that a phase change to a solid state of the refrigerant resulting from the pressure suddenly dropping can be avoided, so that even when the pressure of the refrigerant charging target portion is lower than the triple point pressure (0.52 MPa) of carbon dioxide, it is ensured that a phase change to a solid state of the refrigerant does not occur and the refrigerant is sent to the refrigerant charging target portion. Thus, during the initial stage of charging, a phase change to a solid state of the refrigerant resulting from the pressure suddenly dropping can be reliably avoided.

It will be noted that, in this refrigerant charging method, although the heater 93*b* is disposed in the gas outlet pipe 93 in order to ensure that the specific enthalpy of the refrigerant when entering the refrigerant charging target portion becomes equal to or greater than 430 kJ/kg, it is also possible to employ a configuration where, rather than disposing the heater 93*b*, the length of the gas outlet pipe 93 is lengthened without wrapping insulation or the like around the gas outlet pipe 93 and the heat transfer resulting from the air around that pipe is utilized to heat the refrigerant flowing inside the gas outlet pipe 93.

(4) Modification 1 of First Embodiment

In the above refrigerant charging method, the method was configured to move from the first refrigerant charging step to the second refrigerant charging step after the pressure of the refrigerant charging target portion reaches 0.52 MPa which corresponds to the triple point temperature (−56.56° C.) of carbon dioxide in consideration of reliably avoiding a phase change to a solid state of the refrigerant resulting from a drop in pressure when the refrigerant charging target portion is to be charged with the refrigerant, but in addition to this consideration, the lowest use temperature of the use parts configuring the refrigerant circuit 10 may also considered in order to protect, of the use parts configuring the refrigerant circuit 10 of the air conditioner 1, the refrigerant charging target portion and the valve and the like configuring the portion in the vicinity thereof. Here, of the use parts configuring the refrigerant circuit 10 of the air conditioner 1, as use parts such as the refrigerant charging target portion and the valve and the like configuring the portion in the vicinity thereof, there are the utilization expansion mechanisms 41 and 51 and the close valves 6 and 7, and because parts whose lowest use temperature is in the range of −40° C. to −30° C. are used, it is preferable to set the predetermined pressure to the range of 1 MPa or higher and 1.4 MPa or lower which corresponds to this temperature range. Thus, during the second refrigerant charging step, the use parts of the refrigerant circuit 10 can be protected in addition to reliably avoiding a phase change to a solid state of the refrigerant resulting from a drop in pressure when the refrigerant charging target portion is to be charged with the refrigerant.

Further, in addition to reliably avoiding a phase change to a solid state of the refrigerant resulting from a drop in pressure when the refrigerant charging target portion is to be charged with the refrigerant and protecting the use parts of the refrigerant circuit 10, the melting point of water may also be considered in order to control the occurrence of icing and a large amount of condensation on the valves and the outer surfaces of the pipes (here, the second close valve 27 and refrigerant pipes in the vicinity thereof). Here, because the melting point of water is 0° C., the method may be configured to move from the first refrigerant charging step to the second refrigerant charging step after the predetermined pressure reaches 3.49 MPa which corresponds to the melting point of water. Thus, during the second refrigerant charging step, the occurrence of icing and a large amount of condensation on the valves and the outer surfaces of the pipes can be controlled in addition to reliably avoiding a phase change to a solid state of the refrigerant resulting from a drop in pressure when the refrigerant charging target portion is to be charged with the refrigerant and protecting the use parts of the refrigerant circuit 10.

(5) Modification 2 of First Embodiment

In the refrigerant charging methods of the above first embodiment and modification 1, valves capable of being used in automatic control, such as electrically powered valves and electromagnetic valves, may be employed as the gas outlet valve 93*a* and the liquid outlet valve 94*a*, and a pressure gauge capable of being used in automatic control, such as a pressure sensor and a pressure switch, may be employed as the pressure gauge 95*a*, so that the method automatically moves to the second refrigerant charging step after control to place the liquid outlet valve 94*a* in an open state and control to place the gas outlet valve 93*a* in a closed state is automatically performed when the value of the pressure that the pressure gauge 95*a* has measured reaches the predetermined pressure in the first refrigerant charging step.

Further, a scale capable of setting a predetermined amount of the refrigerant with which the refrigerant charging target portion is to be charged may be employed as the scale 96, and a valve capable of being used in automatic control, such as an electrically powered valve or an electromagnetic valve, may be employed as the inlet valve 91, so that the work of charging the refrigerant charging target portion with the refrigerant is automatically ended after control is performed to place the inlet valve 91*a* in a closed state when the amount of refrigerant that the scale 96 has detected reaches the predetermined amount in the second refrigerant charging step.

It will be noted that, as the scale 96, rather than setting a predetermined amount of the refrigerant with which the refrigerant charging target portion is to be charged, the predetermined amount may be set in a control unit that controls the configural parts of the refrigerant charging unit 9 to determine whether or not the value of the amount of refrigerant corresponding to the value of the change in the weight of the canister 8 measured by the scale 96 has reached the predetermined amount.

Further, as the part that measures the amount of refrigerant with which the refrigerant charging target portion is to be charged, rather than the scale 96, a part that can measure the flow rate of the refrigerant, such as an integrating flow meter, may be disposed in the inlet pipe 91 and the junction pipe 95 to measure the amount of refrigerant with which the refrigerant charging target portion is to be charged.

(6) Refrigerant Charging Method Pertaining to Second Embodiment

With respect to on-site installation of the air conditioner 1, the following refrigerant charging work is performed after the refrigerant circuit 10 has been formed (here, the close valves 26 and 27 are closed) as a result of the heat source unit 2 and the utilization units 4 and 5 being installed on site and the heat source unit 2 and the utilization units 4 and 5 being interconnected via the refrigerant communication pipes 6 and 7 by pipe installation.

In the refrigerant charging method pertaining to the present embodiment, first, the insides of the utilization refrigerant circuits 10*a* and 10*b* of the utilization units 4 and 5 and the refrigerant communication pipes 6 and 7 (called "refrigerant charging target portion" below) are made into vacuums (an extremely low pressure) by an unillustrated vacuum pump or the like. Next, as shown in FIG. 4, the canister 8 serving as a refrigerant-charged container charged with refrigerant (carbon dioxide) is connected to the service port of the second close valve 27 of the heat source unit 2 via a refrigerant charging unit 109. Here, FIG. 4 is a general configural diagram of the air conditioner 1 in a state where the canister 8 and the refrigerant charging unit 109 used in the refrigerant charging method pertaining to the second embodiment of the present invention are connected thereto. It will be noted that the position where the canister 8 is connected to the refrigerant charging target portion is not limited to the service port of the second close valve 27 and may also be the service port of the first close valve 26, or when a separate charge port is disposed in the vicinities of the close valves 26 and 27, then the canister 8 may also be connected to such a charge port.

Here, the refrigerant charging unit 109 is a unit for performing gas-liquid separation of the refrigerant when the refrigerant charging target portion is to be charged with refrigerant from the canister 8 to enable the refrigerant charging target portion to be charged with the gas refrigerant that has been gas-liquid separated and to enable the refrigerant charging target portion to be charged with the liquid refrigerant that has been gas-liquid separated. The refrigerant charging unit 109 mainly includes the inlet pipe 91, the gas-liquid separator 92, a gas outlet pipe 193, the liquid outlet pipe 94 that allows the liquid refrigerant that has been separated in the gas-liquid separator 92 to flow out, and the junction pipe 95 into which the refrigerant flowing through the gas outlet pipe 93 and the refrigerant flowing through the liquid outlet pipe 94 merge and which is connected to the service port of the second close valve 27. It will be noted that because the refrigerant charging unit 109 has the same configuration as that of the refrigerant charging unit 9 of the first embodiment except that the heater 93*b* is not disposed in the gas outlet pipe 193, description in regard to the configurations of the inlet pipe 91, the gas-liquid separator 92, the gas outlet pipe 193, the liquid outlet pipe 94 and the junction pipe 95 will be omitted.

Further, the canister 8 is placed on the scale 96 so that the amount of refrigerant with which the refrigerant charging target portion is to be charged can be measured. Additionally, a cooler 97 through which a cooling medium such as cooling water flows is disposed around the canister 8.

In this refrigerant charging configuration, first, as a first refrigerant charging step, the cooler 97 is activated to cool the canister 8 to 31° C. or lower. Then, after it has been confirmed that the temperature of the canister 8 has become 31° C. or lower, the inlet valve 91*a* and the gas outlet valve 93*a* are placed in an open state and the liquid outlet valve 94*a* is placed in a closed state. Then, the refrigerant emerging from the canister 8 flows into the gas-liquid separator 92 through the inlet pipe 91 and is gas-liquid separated into gas refrigerant and liquid refrigerant. Thereafter, the liquid refrigerant accumulates inside the gas-liquid separator 92, and the gas refrigerant flows into the refrigerant charging target portion while being depressurized to the pressure of the refrigerant target charging portion through the gas outlet valve 93 and the junction pipe 95.

According to the first refrigerant charging step, during the initial stage of charging, a phase change to a solid state of the refrigerant resulting from the pressure suddenly dropping can be avoided.

That is, as mentioned above, the carbon dioxide serving as a refrigerant whose temperature and pressure are higher than the temperature and pressure at a critical point CP (critical temperature of about 31° C., critical pressure of about 7.3 MPa) of carbon dioxide changes to a solid state when the pressure becomes equal to or lower than 0.52 MPa when a sudden pressure drop occurs. In order to prevent this, here, the cooler 97 is activated to cool the canister 8 to 31° C. or lower, so the refrigerant inside the canister 8 is placed in a state that is not a supercritical state (i.e., a state where a liquid state and a gas state can exist) and is gas-liquid separated into gas refrigerant and liquid refrigerant in the gas-liquid separator 92, and the gas refrigerant that has been gas-liquid separated is sent to the refrigerant charging target portion. Thus, even when the pressure suddenly drops when the refrigerant enters the refrigerant charging target portion during the initial stage of charging, there is virtually no longer a situation where the refrigerant changes into a solid state.

Additionally, when the first refrigerant charging step is continued, the pressure of the refrigerant charging target portion is boosted, and the pressure measured by the pressure gauge 95*a* reaches 0.52 MPa as a predetermined pressure. Here, "0.52 MPa as a predetermined pressure" is the triple point pressure which corresponds to the triple point temperature (−56.56° C.) of carbon dioxide, and a phase change to a solid state of the refrigerant resulting from a drop in pressure when the refrigerant target charging portion is to be charged with the refrigerant can be prevented after the refrigerant charging target portion is charged with refrigerant until the pressure of the refrigerant charging target portion becomes equal to or higher than this pressure.

Then, when the pressure measured by the pressure gauge 95*a* reaches 0.52 MPa as mentioned above, the first refrigerant charging step ends and the method moves to a second refrigerant charging step. In the second refrigerant charging step, the liquid outlet valve 94*a* is placed in an open state and the gas outlet valve 93*a* is placed in a closed state. Then, the refrigerant emerging from the canister 8 flows into the gas-liquid separator 92 while being depressurized through the inlet pipe 91 and is gas-liquid separated into gas refrigerant and liquid refrigerant. Thereafter, the gas refrigerant accumulates inside the gas-liquid separator 92, and the liquid refrigerant flows into the refrigerant charging target portion while being depressurized to the pressure of the refrigerant charging target portion through the liquid outlet pipe 94 and the junction pipe 95.

According to the second refrigerant charging step, the speed with which the refrigerant charging target portion is charged with refrigerant can be raised by charging the refrigerant charging target portion with refrigerant in a liquid state.

Additionally, when the second refrigerant charging step is continued, the amount of refrigerant with which the refrigerant charging target portion has been charged through the first and second refrigerant charging steps reaches a predetermined amount. Here, the amount of refrigerant with which the refrigerant charging target portion has been charged is obtained from the value of the change in the weight of the canister 8 measured by the scale 96.

As described above, in the refrigerant charging method pertaining to the second embodiment, first, in the first refrigerant charging step, the refrigerant charging target portion including the refrigerant communication pipes 6 and 7 (here, the utilization refrigerant circuits 10*a* and 10*b* of the utilization units 4 and 5 and the refrigerant communication pipes 6 and 7 that have been vacuumed) is charged with refrigerant in a gas state whose specific enthalpy is relatively large until the pressure of the refrigerant charging target portion rises to a predetermined pressure from the start of charging, and thereafter, in the second refrigerant charging step, the refrigerant charging target portion is charged with refrigerant in a liquid state whose density is large in comparison to the refrigerant in the gas state until the amount of refrigerant with which the refrigerant charging target portion has been charged becomes a predetermined amount. According to this method, during the initial stage of charging, a phase change to a solid state of the refrigerant resulting from the pressure suddenly dropping can be avoided, and thereafter, during the second refrigerant charging step, the speed with which the refrigerant target charging portion is charged with the refrigerant can be raised by charging the refrigerant charging target portion with refrigerant in a liquid state while avoiding a phase change to a solid state of the refrigerant resulting from a drop in pressure when the refrigerant charging target portion is to be charged with the refrigerant, so drawbacks where refrigerant in a solid state (dry ice) becomes a hindrance and the amount of time for charging becomes longer, shortening of the amount of time for charging the refrigeration system with refrigerant, or where the amount of time until the refrigeration system becomes operable after being charged with the refrigerant, can be controlled.

Additionally, in this refrigerant charging method, the method moves from the first refrigerant charging step to the second refrigerant step after the pressure of the refrigerant charging target portion reaches 0.52 MPa which corresponds to the triple point temperature (−56.56° C.) of carbon dioxide, so during the second refrigerant charging step, a phase change to a solid state of the refrigerant resulting from a drop in pressure when the refrigerant charging target portion is to be charged with the refrigerant can be reliably avoided.

Moreover, in this refrigerant charging method, during the first refrigerant charging step of the initial stage of charging, in order to ensure that a phase change to a solid state of the refrigerant resulting from the pressure suddenly dropping can be avoided, the canister 8 serving as a refrigerant-charged container charged with refrigerant is cooled to 31° C. or lower, the refrigerant inside the canister 8 is placed in a state that is not a supercritical state (i.e., a state where a liquid state and a gas state can exist), and then refrigerant in a gas state is sent from the refrigerant-charged container to the refrigerant charging target portion, so that even when the pressure of the refrigerant charging target portion is lower than the triple point pressure (0.52 MPa) of carbon dioxide, it is ensured that a phase change to a solid state of the refrigerant does not occur. Thus, during the initial stage of charging, a phase change to a solid state of the refrigerant resulting from the pressure suddenly dropping can be reliably avoided.

It will be noted that, in this refrigerant charging method, although the cooler 97 is disposed in order to cool the canister 8 to 31° C. or lower, it is also possible to employ a method which waits until the temperature of the canister 8 naturally becomes 31° C. or lower when the air temperature around the canister 8 is low.

(7) Modifications of Second Embodiment

In the above refrigerant charging method pertaining to the second embodiment also, similar to modification 1 of the refrigerant charging method pertaining to the first embodiment, the predetermined pressure may be set to the range of 1 MPa or higher and 1.4 MPa or lower which corresponds to the lowest use temperature (the range of −40° C. to −30° C.) of the use parts configuring the refrigerant circuit 10 in order to protect, of the use parts configuring the refrigerant circuit 10 of the air conditioner 1, the refrigerant charging target portion and the valve and the like configuring the portion in the vicinity thereof, or the predetermined pressure may be set to 3.49 MPa which corresponds to the melting point (0° C.) of water in order to control the occurrence of water adhesion and a large amount of condensation on the valves and the outer surfaces of the pipes.

Thus, in the refrigerant charging method pertaining to the second embodiment also, during the second refrigerant charging step, in addition to reliably avoided a phase change to a solid state of the refrigerant resulting from a drop in pressure when the refrigerant charging target portion is to be charged with the refrigerant, the use parts of the refrigerant circuit 10 can be protected, and the occurrence of water adhesion and a large amount of condensation on the valves and the outer surfaces of the pipes can be controlled.

Further, similar to modification 2 of the refrigerant charging method pertaining to the first embodiment, the method may be configured to be capable of automatically moving from the first refrigerant charging step to the second refrigerant charging step, or may be configured to automatically determine whether or not the amount of refrigerant with which the refrigerant charging target portion has been charged has reached a predetermined amount and automatically end the refrigerant charging work on the basis of that determination.

(8) Other Embodiments

Embodiments of the present invention and modifications thereof have been described on the basis of the drawings, but the specific configurations are not limited to these embodiments and modifications and may be changed in a range that does not depart from the gist of the invention.

(A)

In the aforementioned air conditioner 1, the heat source unit 2 charged beforehand in a manufacturing plant of a manufacturer or the like with carbon dioxide as a refrigerant was brought on site, and the utilization refrigerant circuits 10*a* and 10*b* of the utilization units 4 and 5 and the refrigerant communication pipes 6 and 7 were charged with refrigerant on site, but it is also possible to apply the refrigerant charging method pertaining to the present invention when all charging of the refrigerant circuit including the heat source refrigerant circuit 10*c* of the heat source unit 2 with refrigerant is to be performed on site. Further, it is also possible to apply the refrigerant charging method pertaining to the present invention with respect to charging the heat source refrigerant circuit 10*c* of the heat source unit 2 with refrigerant in a manufacturing plant or the like.

(B)

Further, it is possible to apply the refrigerant charging method pertaining to the present invention not only to the aforementioned air conditioner 1 but also to other refrigeration systems. For example, by using the refrigerant charging method pertaining to the present invention in a heat pump hot water supplying device whose refrigeration cycle has been completed and where refrigerant charging is also to be performed in a manufacturing plant of a manufacturer or the like, the amount of time can be shortened in regard to the refrigerant charging work.

INDUSTRIAL APPLICABILITY

By utilizing the present invention, in a refrigerant charging method in a refrigeration system that uses carbon dioxide as a refrigerant, the amount of time for charging the refrigeration system with the refrigerant and the amount of time until the refrigeration system becomes operable after being charged with the refrigerant can be shortened.

What is claimed is:

1. A refrigerant charging method for a refrigeration system using carbon dioxide as a refrigerant that includes an utilization unit, and a heat source unit interconnected to the utilization unit via refrigerant communication pipes, the method comprising:

a first refrigerant charging step including charging a refrigerant charging target portion including the refrigerant communication pipes with refrigerant in a gas state until a pressure of the refrigerant charging target portion rises to a predetermined pressure after the start of charging; and a second refrigerant charging step including charging the refrigerant charging target portion with refrigerant in a liquid state until an amount of refrigerant charging the refrigerant charging target portion becomes a predetermined amount, the second refrigerant charging step occurring after the first refrigerant charging step.

2. A refrigerant charging method in a refrigeration system using carbon dioxide as a refrigerant, the method comprising:

a first refrigerant charging step including charging a refrigerant charging target portion of the refrigeration system with refrigerant in a gas state until a pressure of the refrigerant charging target portion reaches a predetermined pressure after the start of charging; and a second refrigerant charging step including charging the refrigerant charging target portion with refrigerant in a liquid state until an amount of refrigerant charging the refrigerant charging target portion becomes a predetermined amount, the second refrigerant charging step occurring after the first refrigerant charging step.

3. The refrigerant charging method of claim 2, wherein the predetermined pressure is 0.52 MPa.

4. The refrigerant charging method of claim 2, wherein the predetermined pressure is at least 1 MPa and no more than 1.4 MPa.

5. The refrigerant charging method of claim 2, wherein the predetermined pressure is 3.49 MPa.

6. The refrigerant charging method of claim 2, wherein the first refrigerant charging step includes sending the refrigerant in the gas state from a refrigerant-charged container charged with refrigerant to the refrigerant charging target portion after heating the refrigerant in the gas state such that specific enthalpy of the refrigerant in the gas state when entering the refrigerant charging target portion becomes at least 430 kJ/kg.

7. The refrigerant charging method of claim 2, wherein the first refrigerant charging step includes sending refrigerant in a gas state from a refrigerant-charged container charged with refrigerant to the refrigerant charging target portion after cooling the refrigerant-charged container until it becomes no more than 31° C.

8. The refrigerant charging method of claim 1, wherein the predetermined pressure is 0.52 MPa.

9. The refrigerant charging method of claim 1, wherein the predetermined pressure is at least 1 MPa and no more than 1.4 MPa.

10. The refrigerant charging method of claim 1, wherein the predetermined pressure is 3.49 MPa.

11. The refrigerant charging method of claim 1, wherein the first refrigerant charging step includes sending the refrigerant in the gas state from a refrigerant-charged container charged with refrigerant to the refrigerant charging target portion after heating the refrigerant in the gas state such that specific enthalpy of the refrigerant in the gas state when entering the refrigerant charging target portion becomes at least 430 kJ/kg.

12. The refrigerant charging method of claim 1, wherein the first refrigerant charging step includes sending refrigerant in a gas state from a refrigerant-charged container charged with refrigerant to the refrigerant charging target portion after cooling the refrigerant-charged container until it becomes no more than 31° C.

13. The refrigerant charging method of claim 8, wherein the first refrigerant charging step includes sending the refrigerant in the gas state from a refrigerant-charged container charged with refrigerant to the refrigerant charging target portion after heating the refrigerant in the gas state such that specific enthalpy of the refrigerant in the gas state when entering the refrigerant charging target portion becomes at least 430 kJ/kg.

14. The refrigerant charging method of claim 8, wherein the first refrigerant charging step includes sending refrigerant in a gas state from a refrigerant-charged container charged with refrigerant to the refrigerant charging target portion after cooling the refrigerant-charged container until it becomes no more than 31° C.

15. The refrigerant charging method of claim 9, wherein the first refrigerant charging step includes sending the refrigerant in the gas state from a refrigerant-charged container charged with refrigerant to the refrigerant charging target portion after heating the refrigerant in the gas state such that specific enthalpy of the refrigerant in the gas state when entering the refrigerant charging target portion becomes at least 430 kJ/kg.

16. The refrigerant charging method of claim 9, wherein the first refrigerant charging step includes sending refrigerant in a gas state from a refrigerant-charged container charged with refrigerant to the refrigerant charging target portion after cooling the refrigerant-charged container until it becomes no more than 31° C.

17. The refrigerant charging method of claim 10, wherein the first refrigerant charging step includes sending the refrigerant in the gas state from a refrigerant-charged container charged with refrigerant to the refrigerant charging target portion after heating the refrigerant in the gas state such that specific enthalpy of the refrigerant in the gas state when entering the refrigerant charging target portion becomes at least 430 kJ/kg.

18. The refrigerant charging method of claim 10, wherein the first refrigerant charging step includes sending refrigerant in a gas state from a refrigerant-charged container charged with refrigerant to the refrigerant charging target portion after cooling the refrigerant-charged container until it becomes no more than 31° C.

19. The refrigerant charging method of claim 1, wherein the first refrigerant charging step includes sending refrigerant in a gas state from a refrigerant-charged container charged with refrigerant to the refrigerant charging target portion after heating the refrigerant in the gas state such that specific enthalpy of the refrigerant in the gas state when entering the refrigerant charging target portion is in region higher than a line joining points P1 to P5 in a Mollier diagram of carbon dioxide, and point P1 is a point where temperature is 0° C. and pressure is 3.49 MPa, point P2 is a point where temperature is 10° C. and pressure is 4.24 MPa, point P3 is a point where temperature is 20° C. and pressure is 5.07 MPa, point P4 is a point where temperature is 30° C. and pressure is 6.00 MPa, and point P5 is a point where temperature is 40° C. and pressure is 7.06 MPa on the Mollier diagram of carbon dioxide.

20. The refrigerant charging method of claim 2, wherein the first refrigerant charging step includes sending refrigerant in a gas state from a refrigerant-charged container charged with refrigerant to the refrigerant charging target portion after heating the refrigerant in the gas state such that specific enthalpy of the refrigerant in the gas state when entering the refrigerant charging target portion is in region higher than a line joining points P1 to P5 in a Mollier diagram of carbon dioxide, and point P1 is a point where temperature is 0° C. and pressure is 3.49 MPa, point P2 is a point where temperature is 10° C. and pressure is 4.24 MPa, point P3 is a point where temperature is 20° C. and pressure is 5.07 MPa, point P4 is a point where temperature is 30° C. and pressure is 6.00 MPa, and point P5 is a point where temperature is 40° C. and pressure is 7.06 MPa on the Mollier diagram of carbon dioxide.

* * * * *